US005261560A

United States Patent [19]

Wang

[11] Patent Number: 5,261,560

[45] Date of Patent: Nov. 16, 1993

[54] UTENSIL RECEPTACLE

[76] Inventor: Paul S. Wang, 13620 Benson Ave., Chino, Calif. 91710

[21] Appl. No.: 981,381

[22] Filed: Nov. 25, 1992

Related U.S. Application Data

[62] Division of Ser. No. 946,564, Sep. 18, 1992, Pat. No. 5,197,623.

[51] Int. Cl.[5] ..... B65D 25/10; A47J 43/28

[52] U.S. Cl. ..... 220/735; 220/212; 30/150; 30/323; 30/326; 206/372; 206/553; 7/168

[58] Field of Search ..... 220/212, 334, 735; 30/142, 147, 148, 149, 150, 323, 326, 331; 206/372, 373, 553; 7/118, 156, 168

[56] References Cited

U.S. PATENT DOCUMENTS

| | | | |
|---|---|---|---|
| 854,745 | 5/1907 | King | 30/150 |
| 973,930 | 10/1910 | Fink | 220/735 X |
| 1,015,830 | 1/1912 | Penney | 220/735 X |
| 1,036,664 | 8/1912 | Marble | 7/168 |
| 1,288,617 | 12/1918 | Kudiszewski | 30/149 X |
| 1,452,337 | 4/1923 | Brecel | 30/147 X |
| 2,105,382 | 1/1938 | Van Horn | 30/150 X |
| 2,371,505 | 3/1945 | Coffey | 220/735 X |
| 2,473,758 | 6/1949 | Maitlen | 7/168 X |
| 4,204,294 | 5/1980 | Halverson | 7/168 X |
| 4,539,749 | 9/1985 | Hyeong-Woon | 30/147 |

FOREIGN PATENT DOCUMENTS

| | | | |
|---|---|---|---|
| 654286 | 4/1929 | France | 7/168 |

*Primary Examiner*—Allan N. Shoap
*Assistant Examiner*—Vanessa Caretto
*Attorney, Agent, or Firm*—Keith D. Beecher

[57] ABSTRACT

A receptacle for a spoon and fork; The spoon and the fork are pivotally mounted to the underside to the top of the receptacle, and the top is hinged to the bottom of the receptacle so that it may be opened to permit the spoon and fork to be turned to a position in which they protrude through the ends of the receptacle, and the top may then be closed down to a snap fit with the bottom of the receptacle to hold the spoon and fork in place, and enable the receptacle to serve as a handle for the spoon and fork.

3 Claims, 2 Drawing Sheets

UTENSIL RECEPTACLE

This Application is a Division of Co-Pending Application Serial No. 07/946,564, filed Sep. 18, 1992 now U.S. Pat. No. 5,197,623.

BACKGROUND OF THE INVENTION

A thermal jar is provided in Co-pending Application Ser. No. 07/946,564 for carrying snacks, and the like, and which is provided with a removable receptacle for appropriate utensils, such as a spoon and fork, the receptacle being received in a channel formed in a top surface of the cover of the jar in a snap fit relationship. This Divisional Application is directed to the receptacle.

The jar of the Co-pending Application is particularly useful for carrying snacks for children to school and on picnics. The jar itself is preferably formed of a thermal insulating material, and its cover is also formed of a thermal insulating material and screwed to the open top of the jar. The cover has a channel formed in its top surface for receiving the utensil receptacle in a snap-fit relationship.

The end portions of appropriate utensils, such as a fork and spoon are pivotally mounted to the inner surface of the top of the receptacle, and they project through the ends of the receptacle when they are to be used. The fork and spoon may be turned to a position in which they overlap one another and are fully contained within the receptacle when not in use. Then, the receptacle top may be snapped to a closed position, and the receptacle itself may be snapped into the channel in the cover of the jar. A selected snack may be placed within the jar, and the cover of the jar with the receptacle in place may be screwed onto the open top of the jar.

To use the spoon and fork, the receptacle is removed from the channel in the cover, and its top is turned up to an open position. The spoon and fork are then turned until they protrude from each end of the receptacle. The receptacle top is then snapped down to its closed position to hold the spoon and fork in place. The spoon and fork may be used with the receptacle itself serving as a handle.

DETAILED DESCRIPTIONS OF THE ILLUSTRATED EMBODIMENT

The jar of the Co-pending Application is designated 10 in FIGS. 1–4, and it has a cover 12 screwed to its open top. The jar 10 and cover 12 are preferably formed of thermal insulating material, so that snacks, or other foods contained in the jar may be held in a cool or hot condition.

Figure 1:
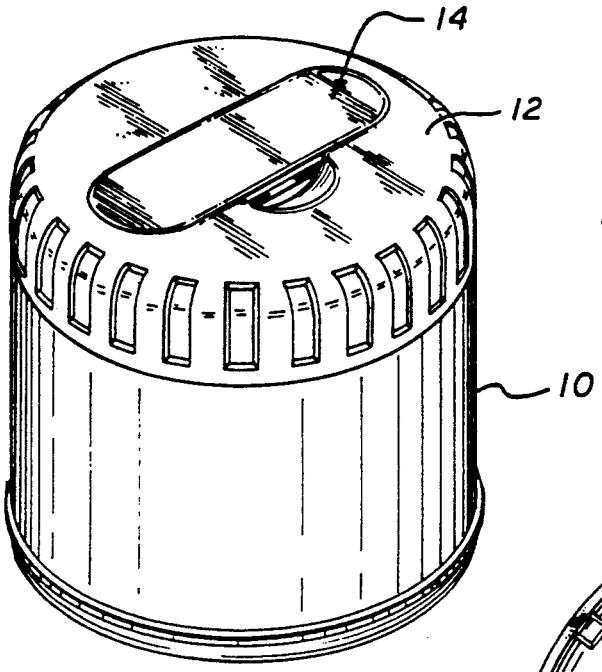
FIG. 1 is a side perspective view of the thermal jar of the Co-pending Application with the cover attached to the top of the jar, and with the utensil receptacle of the present invention snapped into place in a channel in the cover.
Figure 2:
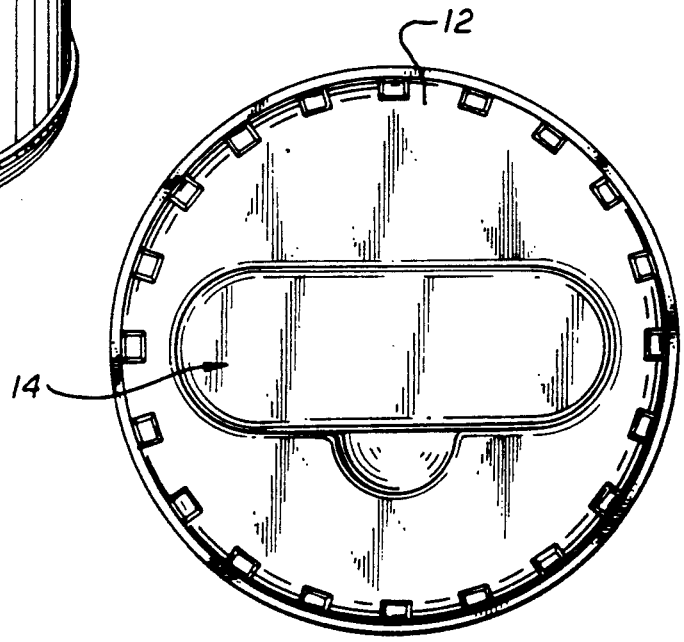
FIG. 2 is a top plan view of the assembly of FIG. 1.
Figure 3:
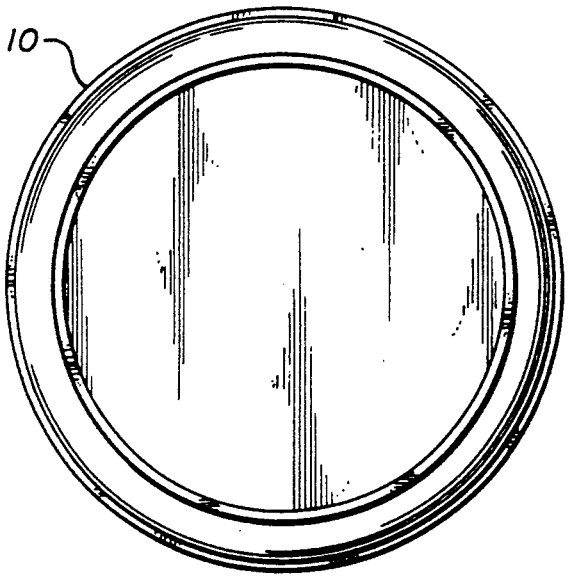
FIG. 3 is a bottom view of the assembly.
Figure 4:
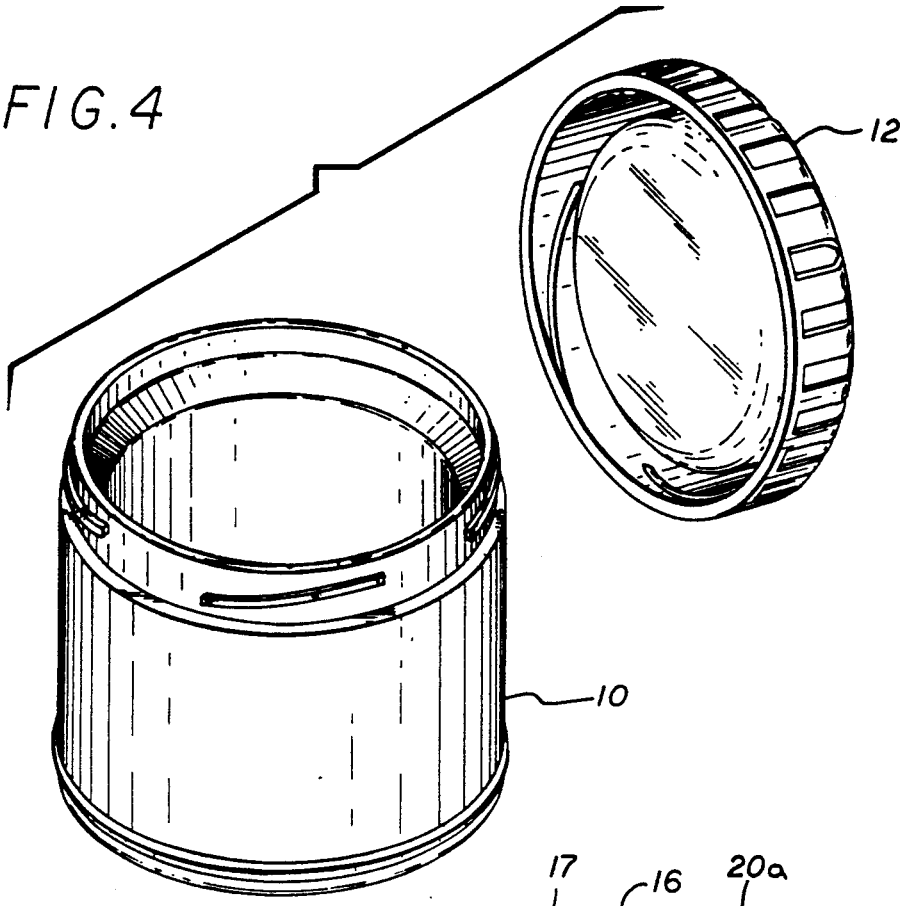
FIG. 4 is a view of the assembly of FIG. 1 with the cover removed from the jar and showing the bottom surface of the cover.
Figure 5:
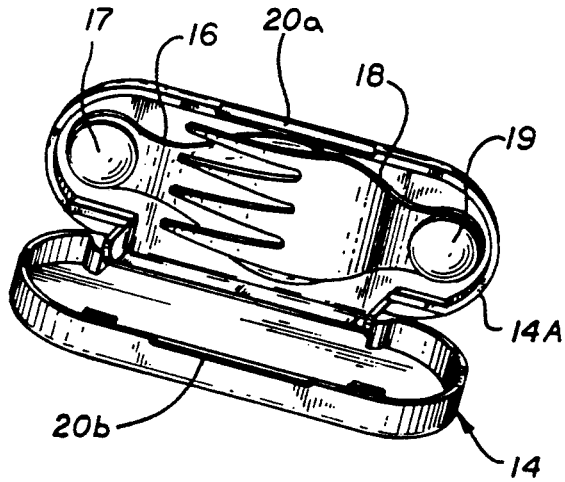
FIG. 5 is a perspective of the utensil receptacle, with its top turned to its opened position to reveal the utensils pivotally mounted to the inner surface of the top.
Figure 6:
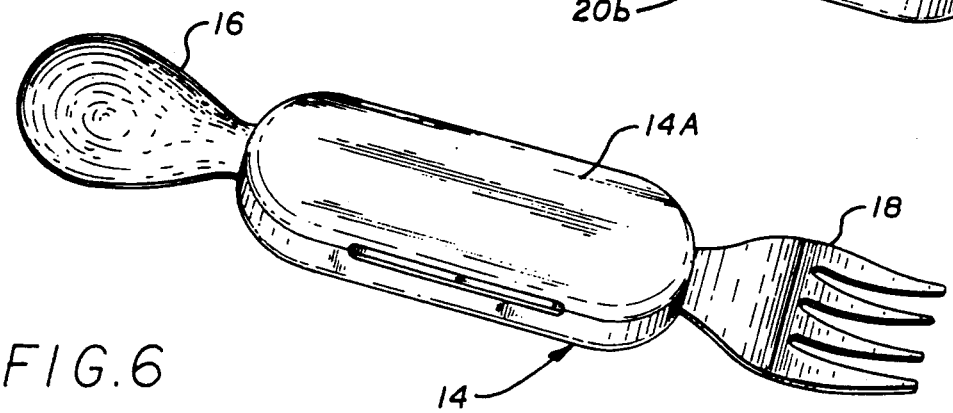
FIG. 6 is a perspective view of the receptacle showing the utensils turned to protrude through each of the receptacle, so that the receptacle may serve as a handle for the utensils.

An elongated receptacle 14 is carried in an elongated channel formed on the outer surface of the cover 12, and it is snapped into a snap-fit relationship in the channel, as shown in FIGS. 1 and 2. The receptacle 14 has a top **14*a* as shown in FIGS. 5 and 6, which is hinged to the receptacle itself. Appropriate utensils, such as a spoon 16 and fork 18 are pivotally mounted to the underside of the top 14*a* by pivot pins 17 and 19**.

The utensils themselves are actually the head portions of the spoon and fork. When the utensils are turned to the position shown in FIG. 5 in which they overlap one another, the top **14*a* of the receptacle 14 may be closed, and the receptacle may be placed in the channel in the cover 12 of the jar, as shown in FIG. 1**.

When the utensils are turned so that they protrude through the ends of the top **14*a*, as shown in FIG. 6, the top may be snapped closed by snap-fit fasteners 20A, 20B to trap the utensils in the protruding position. The, the utensils may be used with the receptacle 14** serving as a handle.

It will be appreciated that while a particular embodiment of the invention has been shown and described, modifications may be made. It is intended in the Claims to cover all modifications which come within the true spirit and scope of the invention.

I claim:

1. An elongated receptacle having a bottom portion and a top portion hinged to said bottom portion, each of said top and bottom portions having an inside surface, a first utensil mounted to said top portion adjacent to one end of the receptacle, said first utensil being angularly movable about an axis perpendicular to the plane of said top portion between a first position in which it extends along the inside surface of said top portion toward the other end of the receptacle, and a second position in which it protrudes beyond said one end of the receptacle, and which includes a second utensil pivotally mounted to said top portion at the other end of the receptacle and angularly movable about an axis perpendicular to the plane of said top portion between a first position in which it extends over the first utensil toward said one end of the receptacle and a second position in which it protrudes beyond the other end of the receptacle to permit the top portion to be closed down on the bottom portion to hold the utensils in place in their second position to enable the receptacle to serve as a handle for the utensils.

2. The receptacle defined in claim 1 in which said utensils respectively comprise a spoon and a fork.

3. The receptacle defined in claim 1, and which includes snap-fit fastener means mounted on said top and bottom portions to enable the top portion to be snapped closed on the bottom portion to trap the utensils in their protruding positions.

* * * * *